US008888203B2

(12) United States Patent
Chen et al.

(10) Patent No.: US 8,888,203 B2
(45) Date of Patent: Nov. 18, 2014

(54) DOOR CLOSURE STRUCTURE FOR ROTARY DOOR AND SIDE-BY-SIDE REFRIGERATOR COMPRISING THE SAME

(75) Inventors: Hao Chen, Hefei (CN); Lingyun Li, Hefei (CN)

(73) Assignees: Hefei Midea Refrigerator Co., Ltd., Hefei (CN); Hefei Hualing Co., Ltd., Hefei (CN)

( * ) Notice: Subject to any disclaimer, the term of this patent is extended or adjusted under 35 U.S.C. 154(b) by 0 days.

(21) Appl. No.: 14/006,298

(22) PCT Filed: May 23, 2011

(86) PCT No.: PCT/CN2011/074539

§ 371 (c)(1), (2), (4) Date: Sep. 19, 2013

(87) PCT Pub. No.: WO2012/159259

PCT Pub. Date: Nov. 29, 2012

(65) Prior Publication Data

US 2014/0009057 A1 Jan. 9, 2014

(51) Int. Cl.

| | |
|---|---|
| ***A47B 96/04*** | (2006.01) |
| ***E06B 3/36*** | (2006.01) |
| ***E05C 19/04*** | (2006.01) |
| ***E05D 11/10*** | (2006.01) |
| ***F25D 23/02*** | (2006.01) |
| *E05B 65/00* | (2006.01) |

(52) U.S. Cl.

CPC . *E06B 3/36* (2013.01); *E05C 19/04* (2013.01); *E05D 11/1078* (2013.01); *F25D 23/028* (2013.01); *E05B 65/0042* (2013.01); *E05Y 2201/638* (2013.01); *E05Y 2900/31* (2013.01); *F25D 2323/024* (2013.01)

USPC ..... 312/405; 312/324

(58) Field of Classification Search

USPC ..... 312/405, 326–329; 62/449; 49/399

See application file for complete search history.

(56) References Cited

U.S. PATENT DOCUMENTS

| | | | | |
|---|---|---|---|---|
| 3,259,936 | A * | 7/1966 | Sheridan | 16/49 |
| 5,579,606 | A * | 12/1996 | Kim | 49/386 |
| 5,975,663 | A * | 11/1999 | Becker | 312/405 |
| 6,883,841 | B2 * | 4/2005 | Kawabata et al. | 292/336.3 |
| 7,543,897 | B2 | 6/2009 | Kim | |

(Continued)

FOREIGN PATENT DOCUMENTS

| | | |
|---|---|---|
| CN | 2160728 | 4/1994 |
| CN | 1637372 | 7/2005 |
| CN | 1743774 | 3/2006 |
| KR | 2020090004389 | 5/2009 |

*Primary Examiner* — Hanh V Tran

(74) *Attorney, Agent, or Firm* — Hodgson Russ LLP

(57) ABSTRACT

A door closure structure for a rotary door and a side-by-side refrigerator comprising the same are provided. The door closure structure comprises: a slide passage formed in an upper end surface of the rotary door; a hinge assembly comprising a hinge body, a hinge plate and a hinge shaft; and a swing plate extended in a lateral direction, a first end of the swing plate pivotably connected to a front end of the hinge body, an angle between the swing plate and the upper end surface of the rotary door ranging from 0 to 90°; a spring having two ends connected to the swing plate and the front end of the hinge body respectively; and a roller rotatably disposed at a second end of the swing plate to catch into or roll out of the slide passage following a movement of the swing plate.

19 Claims, 4 Drawing Sheets

(56) References Cited

U.S. PATENT DOCUMENTS

| | | | | |
|---|---|---|---|---|
| 2005/0127683 | A1 | 6/2005 | Nam | |
| 2006/0232176 | A1* | 10/2006 | Kim et al. | 312/405 |
| 2006/0238091 | A1* | 10/2006 | Linke et al. | 312/405 |
| 2008/0116777 | A1* | 5/2008 | Kappler et al. | 312/404 |
| 2008/0168618 | A1* | 7/2008 | Hottmann | 16/50 |
| 2008/0284179 | A1* | 11/2008 | Gerner et al. | 292/13 |
| 2009/0056072 | A1* | 3/2009 | McKinney et al. | 16/63 |
| 2009/0064457 | A1* | 3/2009 | Brustle | 16/292 |
| 2010/0109497 | A1* | 5/2010 | Blersch et al. | 312/405 |

* cited by examiner

DOOR CLOSURE STRUCTURE FOR ROTARY DOOR AND SIDE-BY-SIDE REFRIGERATOR COMPRISING THE SAME

FIELD

The present disclosure relates to a refrigerating apparatus field, and more particularly relates to a door closure structure for a rotary door and a side-by-side refrigerator comprising the same.

BACKGROUND

A conventional side-by-side refrigerator usually has a large refrigerating chamber space, which is convenient to use. However, as a swing turnover beam is disposed between two doors of the side-by-side refrigerator in order to provide a better sealing effect for the refrigerating chamber, one door of the refrigerator is liable to be opened due to a pressure caused when the other door is closed with a large force. Due to a bad closure stopping effect, the door of the refrigerator is usually not closed tightly, which makes the refrigerator leak cold and a condensation power consumption increase.

SUMMARY

The present disclosure aims to solve at least one of the problems in the prior art.

For this, one objective of the present disclosure is to provide a door closure structure for a rotary door which has a better door closure stopping effect.

Another objective of the present disclosure is to provide a side-by-side refrigerator comprising the above door closure structure.

According to embodiments of a first aspect of the present disclosure, a door closure structure for a rotary door rotatably mounted on a main body is provided. The door closure structure comprises: a slide passage, formed in an upper end surface of the rotary door; a hinge assembly, in which the rotary door is mounted on the main body by the hinge assembly and the hinge assembly comprises: a hinge body, fixed on the main body in a longitudinal direction; a hinge plate, provided with a hinge hole, and connected to a rear end of the hinge body; and a hinge shaft fitted with the hinge hole; and a swing plate extended in a lateral direction, in which a first end of the swing plate is pivotably connected to a front end of the hinge body, and an angle between the swing plate and the upper end surface of the rotary door ranges from 0 to 90°; a spring having two ends connected to the swing plate and the front end of the hinge body respectively; and a roller rotatably disposed at a second end of the swing plate to catch into or roll out of the slide passage following a movement of the swing plate.

The door closure structure according to embodiments of the present disclosure has a good closure stopping effect, and the door is not easy to open when acted on by an external interference force. Furthermore, the door closure structure according to the present disclosure has a simple structure and a low cost. Moreover, the user feels comfortable when opening or closing a door with the door closure structure according to the present disclosure.

In addition, the door closure structure according to embodiments of the present disclosure may also have the following additional technical features.

The door closure structure further comprises an inclined plate inclined upwards from a first end thereof to a second end thereof, in which the first end of the inclined plate is fixed with the front end of the hinge body and the swing plate is pivotably connected with the second end of the inclined plate. Thus, a height of the swing plate is greater than that of the hinge body, which makes it easier for the roller to reach the slide passage.

The door closure structure further comprises a first pin, in which the swing plate is pivotably connected with the inclined plate via the first pin.

Two parallel mounting bars spaced apart from each other are extended from the second end of the swing plate in the lateral direction, and the door closure structure further comprises a second pin fixed between the two mounting bars, in which the roller is fitted over the second pin.

Alternatively, the second pin is provided with two retainers disposed on two sides of the roller respectively, in order to prevent the roller from sliding back and forth on the second pin.

The door closure structure further comprises a supporting plate disposed below the swing plate and parallel with the upper end surface of the rotary door, in which a first end of the supporting plate is fixed with the inclined plate. Thus, it is possible to precisely limit a downward limiting position of a pivoting of the swing plate to be parallel to the upper end surface of the rotary door, thus preventing a damage to the upper end surface of the rotary door.

According to embodiments of a second aspect of the present disclosure, a side-by-side refrigerator is provided. The side-by-side refrigerator comprises two door closure structures according to embodiments of the first aspect of the present disclosure; a main body with a open front surface, in which the hinge bodies of the two door closure structures are respectively disposed on a left side and a right side of a front edge of the main body; and a left door and a right door rotatably mounted on the front surface of the main body, in which the slide passages of the two door closure structures are disposed on upper end surfaces of the left door and the right door respectively.

In one embodiment of the present disclosure, notches are formed in inner walls of the upper end surfaces of the left door and the right door respectively, and a stopper having a surface with a predetermined slope is disposed in each notch, in which the slide passage is defined by the stopper and the notch. Thus, during the process of closing the door, when the roller enters into the slide passage, a sliding resistance may be reduced due to the slope of the stopper, and thus a door closure resistance may be reduced.

Alternatively, the stopper and the roller are made of polyformaldehyde.

Alternatively, spacers are disposed on bottoms of the left door and the right door for adjusting height thereof respectively. Thus, a fitting between the roller and the left door and a fitting between the roller and the right door are ensured and an influence on a heat preservation effect of the refrigerator caused by a mismatch is avoided.

With the side-by-side refrigerator according to embodiments of the present disclosure, by using the above door closure structure, a better door closure stopping effect is obtained, and one door is not opened due to a pressure caused when the other door is closed with a large force, which prevents the refrigerator from leaking cold and reduces the condensation power consumption.

Additional aspects and advantages of the embodiments of the present disclosure will be given in part in the following descriptions, become apparent in part from the following descriptions, or be learned from the practice of the embodiments of the present disclosure.

BRIEF DESCRIPTION OF THE DRAWINGS

These and other aspects and advantages of the disclosure will become apparent and more readily appreciated from the following descriptions taken in conjunction with the drawings in which.

DETAILED DESCRIPTION

Figure 1:
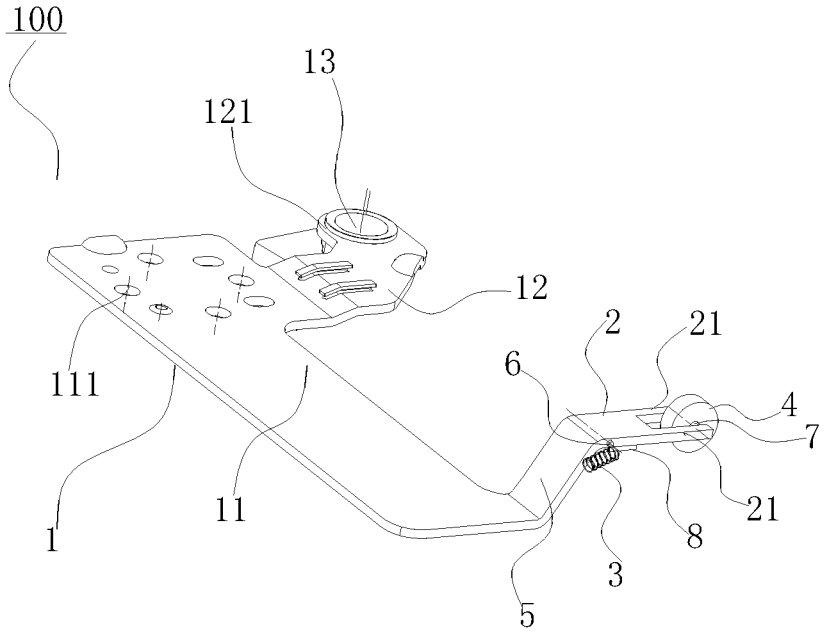
FIG. 1 is a schematic view of a door closure structure for a rotary door according to an embodiment of the present disclosure.

Embodiments of the present disclosure will be described in detail in the following descriptions, examples of which are shown in the accompanying drawings, in which the same or similar elements and elements having same or similar functions are denoted by like reference numerals throughout the descriptions. The embodiments described herein with reference to the accompanying drawings are explanatory and illustrative, which are used to generally understand the present disclosure. The embodiments shall not be construed to limit the present disclosure.

It is to be understood that phraseology and terminology used herein with reference to device or element orientation (such as, terms like "longitudinal", "lateral", "up", "down", "front", "rear", "left", "right", "vertical", "horizontal", "top", "bottom", "inside", "outside") are only used to simplify description of the present invention, and do not indicate or imply that the device or element referred to must have or operated in a particular orientation. They cannot be seen as limits to the present disclosure.

Moreover, terms of "first" and "second" are only used for description and cannot be seen as indicating or implying relative importance.

Unless otherwise stipulated and restricted, it is to be explained that terms of "installation", "linkage" and "connection" shall be understood broadly, for example, it could be permanent connection, removable connection or integral connection; it could be direct linkage, indirect linkage or inside linkage within two elements. Those of ordinary skill in the art shall understand the concrete notations of the terms mentioned above according to specific circumstances.

In the following, a door closure structure 100 for a rotary door according to embodiments of a first aspect of the present disclosure is described in detail with reference to FIGS. 1-7. Hereinafter, the door closure structure 100 is explained to be used in a refrigerator as an example, and the door closure structure 100 is used between a door 200 and a main body 400 of the refrigerator (see, e.g., FIG. 7).

As shown in FIGS. 1-6, the door closure structure 100 according to an embodiment of the present disclosure comprises a hinge assembly 1, a swing plate 2 extended in a lateral direction, a spring 3 and a roller 4. The rotary door 200 is mounted on the main body by the hinge assembly 1 and a slide passage 210 is formed on an upper end surface of the door 200.

Figure 2:
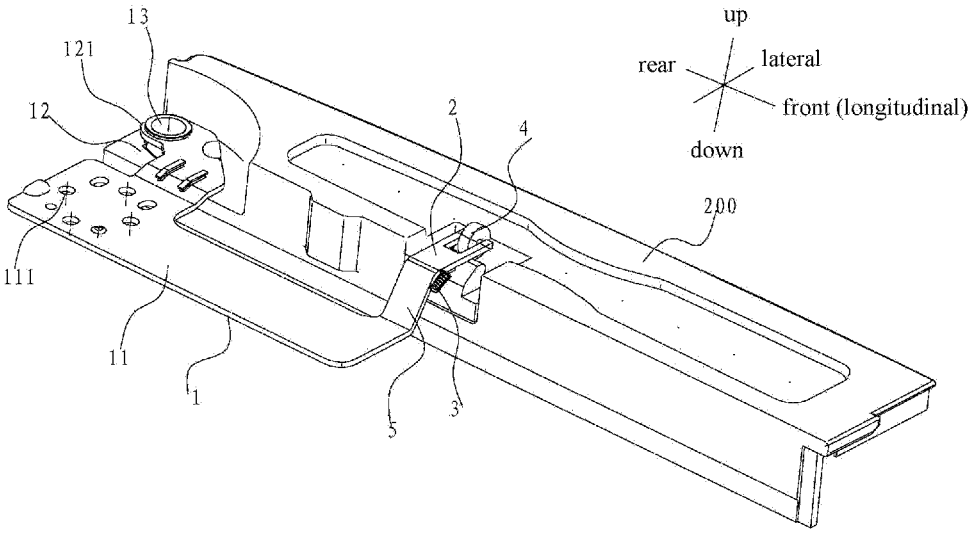
FIG. 2 is a schematic view showing a cooperation of a door closure structure according to an embodiment of the present disclosure and a door in a door closure state.

The hinge assembly 1 comprises a hinge body 11, a hinge plate 12 and a hinge shaft 13. As shown in FIG. 2, the hinge body 11 is fixed on the main body in a longitudinal direction. For example, the hinge body 11 is bolted to the main body by a screw hole disposed in the hinge body 11. The hinge plate 12 is provided with a hinge hole 121 and connected to a rear end of the hinge body 11, and the hinge shaft 13 is fitted with the hinge hole 121 to make the door 200 rotatable relative to the main body.

A first end (for example, the left end of the swing plate 2 shown in FIGS. 1-3) of the swing plate 2 is pivotably connected to a front end of the hinge body 11, and the swing plate 2 is configured to pivot at an angle ranging from 0 to 90° to the upper end surface of the door 200. In other words, a second end of the swing plate 2 can move up and down in a certain range, but a limiting position of the downward movement is a position parallel to a horizontal plane. Two ends of the spring 3 are connected to the swing plate 2 and the front end of the hinge body 11 respectively. The roller 4 is rotatably disposed at the second end of the swing plate 2 to catch into or roll out of the slide passage 210 following the movement of the swing plate 2.

Figure 4:
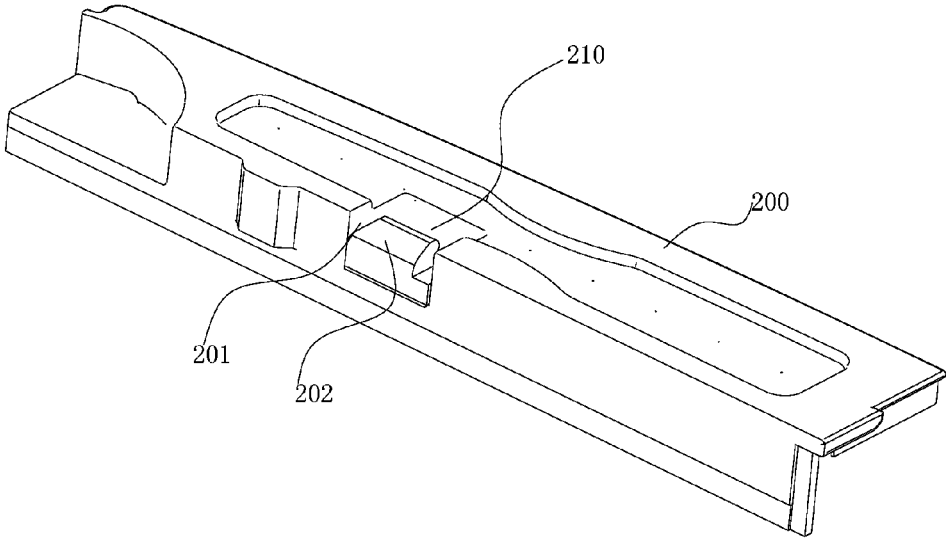
FIG. 4 is a schematic view of a slide passage of the door shown in FIG. 2.
Figure 5:
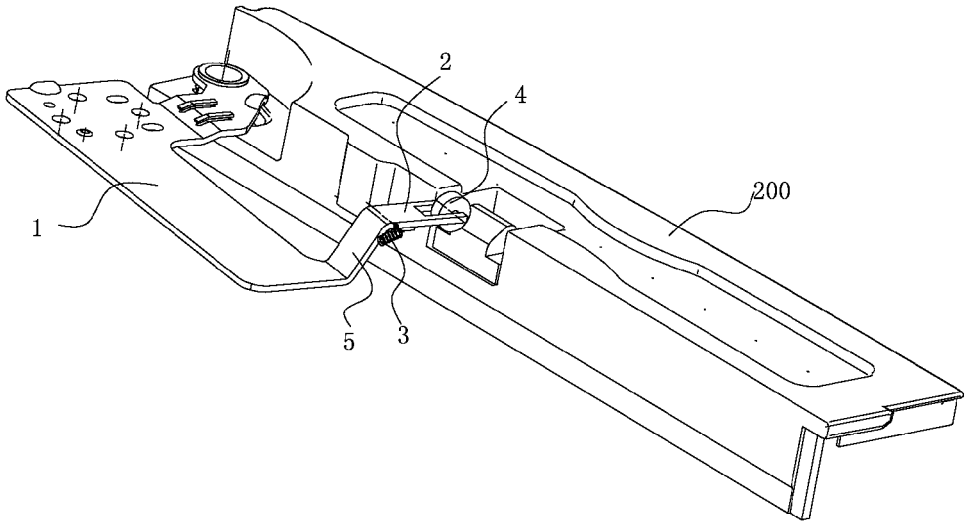
FIG. 5 is a schematic view showing the cooperation of a door closure structure according to an embodiment of the present disclosure and a door when the door has not been closed.
Figure 6:
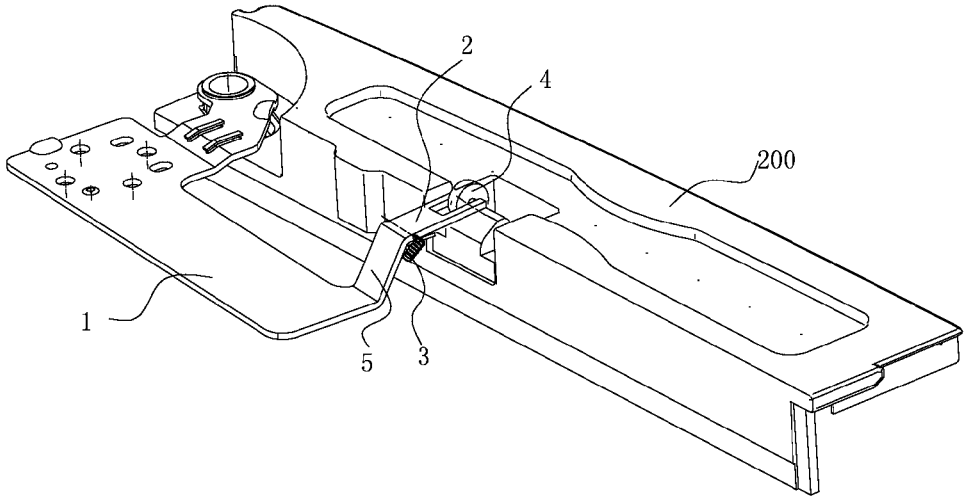
FIG. 6 is a schematic view showing the cooperation of the door closure structure and the door shown in FIG. 5 when the door is being closed.
Figure 7:
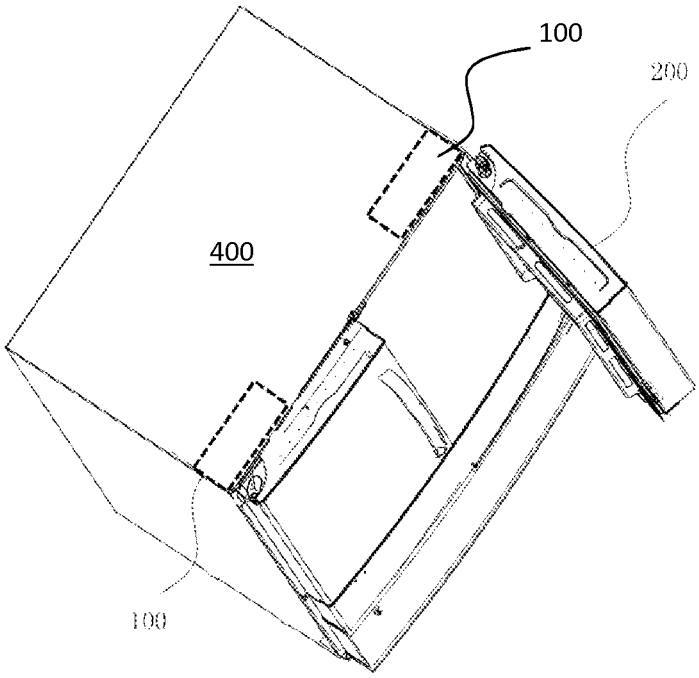
FIG. 7 is a schematic representation of a refrigerator showing the door closure structure according to an embodiment of the present disclosure.

As shown in FIGS. 4-6, when the door 200 is closed to a certain position, the swing plate 2 connected with the hinge body 11 moves around the hinge shaft 13 to approach the door 200 and press the door 200 gradually. At this time, the roller 4 is pressed by the door 200 to make the swing plate 2 pivot upwards and the spring 3 is elongated. When the roller 4 continues moving until it is above the slide passage 210 (i.e., when the door 200 is closed), due to an elastic restoring force of the spring 3, the swing plate 2 is pivoted downwards to make the roller 4 catch into the slide passage 210. At this time, a door closure stopping effect for the door 200 is generated, and a tight door closure of the door 200 is obtained, which prevents the door 200 from being opened when disturbed.

The door closure structure according to embodiments of the present disclosure has a good door closure stopping effect, and the door is not easy to open when acted on by an external interference force. Furthermore, the door closure structure according to the present disclosure has a simple structure and a low cost. Moreover, the user feels comfortable when opening or closing a door with the door closure structure according to embodiments of the present disclosure.

In one embodiment of the present disclosure, the door closure structure 100 further comprises an inclined plate 5. The inclined plate 5 inclines upwards from a first end (i.e. a left end in FIG. 1) thereof to a second end (i.e. a right end in FIG. 1) thereof. The first end of the inclined plate 5 is fixed with the front end of the hinge body 11, and the swing plate 2 is pivotably connected with the second end of the inclined plate 5. Thus, the height of the swing plate 2 is greater than that of the hinge body 11, which makes it easier for the roller 4 to reach the slide passage 210 of the door 200.

Figure 3:
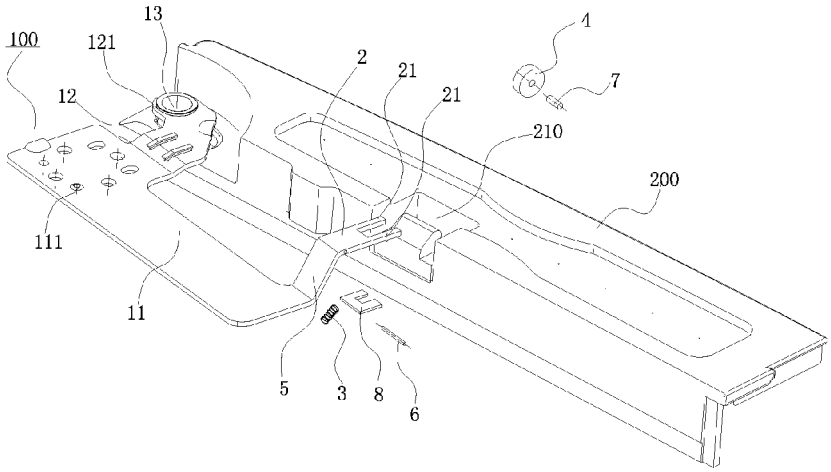
FIG. 3 is an exploded view of the door closure structure shown in FIG. 2.

As shown in FIGS. 1-3, the door closure structure 100 according to an embodiment of the present disclosure further comprises a first pin 6. The swing plate 2 is pivotably connected with the inclined plate 5 via the first pin 6. Further, two parallel mounting bars 21 spaced apart from each other are extended form the second end of the swing plate 2 in the lateral direction. At the same time, the door closure structure 100 further comprises a second pin 7. The second pin 7 is fixed between the two mounting bars 21, and the roller 4 is fitted over the second pin 7. Thus, the roller 4 is rotatably disposed on the second end of the swing plate 2 to save space.

Alternatively, the second pin 7 is provided with two retainers (not shown). The two retainers are disposed on two sides of the roller 4 respectively, in order to prevent the roller 4 from sliding back and forth on the second pin 7.

In some embodiments of the present disclosure, as shown in FIGS. 1-3, the door closure structure 100 further comprises a supporting plate 8. The supporting plate 8 is disposed below the swing plate 2 and is parallel with the upper end surface of the door 200. A first end of the supporting plate 8 is fixed with the inclined plate 5, for example, by welding. Thus, it is possible to precisely limit the downward limiting position of a pivoting of the swing plate 2 to be parallel to the upper end surface of the door 200, thus preventing a damage to the upper end surface of the door 200.

It should be understood that the door closure structure according to embodiments of the present disclosure may also be used in other types of doors and cabinet doors.

According to an embodiment of the present disclosure, a side-by-side refrigerator is also provided. The side-by-side refrigerator comprises two door closure structures 100 described above, a left door, a right door and a main body. The main body is provided with an open front surface. The hinge bodies 11 of the two door closure structures are respectively disposed on a left side and a right side of a front edge of the main body. The left door and the right door are rotatably mounted on the front surface of the main body via the hinge body 11, and the slide passages 210 described above are disposed on upper end surfaces of the left door and the right door respectively.

Specifically, as shown in FIG. 5, notches 201 are formed in inner walls of the upper end surfaces of the left door and the right door respectively, and a stopper 202 is disposed in the edge of each notch 201. Each stopper 202 has a surface with a predetermined slope, and the slide passage 210 is defined by the stopper 202 and the notch 201. Thus, during the door closure process, when the roller 4 enters into the slide passage 210, the sliding resistance may be reduced due to the slope of the stopper 202, and thus the door closure resistance may be reduced.

Alternatively, the stopper 202 may be fixed in the notch 201 via a plurality of screws. Alternatively, the stopper 202 and the roller 4 are made of polyformaldehyde (POM).

In some embodiments of the present disclosure, in order to ensure a fitting between the roller 4 and the left door and a fitting between the roller 4 and the right door and to prevent an influence on a heat preservation effect caused by a mismatch, spacers (not shown) for adjusting the height of the left door and the right door are disposed on bottoms of the left door and the right door respectively.

In the following, a working process of closing and opening the door is described in detail with reference to FIGS. 2, 5 and 6. The working process of closing and opening the left door is described below as an example.

Firstly, during the process of closing the door, when the door 200 is closed to a certain position, the swing plate 2 connected with the hinge body 11 moves around the hinge shaft 13 to approach the door 200 and presses the door 200 gradually to generate a certain resistance, as shown in FIG. 5. When the user closes the door with a small force, the roller 4 is pressed by the door 200 to make the swing plate 2 pivot upwards and at the same time the spring 3 is elongated. As shown in FIG. 6, when the roller 4 continues moving until it is above the slide passage 210 (i.e., when the door 200 is closed), due to the elastic restoring force of the spring 3, the swing plate 2 is pivoted downwards to make the roller 4 catch into the slide passage 210, as shown in FIG. 2. Thus, the door 200 is closed tightly and a door closure stopping of the door 200 is ensured.

The process of opening the door is just opposite to that of closing the door. When the user pulls the roller 4 out of the slide passage 210 to put it on the stopper 202 with a small force, the swing plate 2 is driven to pivot upwards and at the same time the spring 3 is elongated, as shown in FIG. 6. When the door 200 is opened to a certain degree, the roller 4 leaves from the stopper 202, and the spring 3 returns to an original state to drive the swing plate 2 to move downwards, as shown in FIG. 5. Thus, the process of opening the door is completed.

Other components of the side-by-side refrigerator according to embodiments of the present disclosure, such as an overturn beam in the center of the refrigerating chamber, a refrigerating control system, a freezing control system, and a refrigerating system, and the operation of the other components are known to those skilled in the art and not described in detail herein.

With the side-by-side refrigerator according to embodiments of the present disclosure, by using the above door closure structures, a better door closure stopping effect is obtained and one door is not opened due to the pressure caused when the other door is closed with a large force, which prevents the refrigerator from leaking cold and reduces a condensation power consumption.

Reference throughout this specification to "an embodiment", "some embodiments", "one embodiment", "an example", "a specific examples", or "some examples" means that a particular feature, structure, material, or characteristic described in connection with the embodiment or example is included in at least one embodiment or example of the disclosure. Thus, the appearances of the phrases such as "in some embodiments", "in one embodiment", "in an embodiment", "an example", "a specific examples", or "some examples" in various places throughout this specification are not necessarily referring to the same embodiment or example of the disclosure. Furthermore, the particular features, structures, materials, or characteristics may be combined in any suitable manner in one or more embodiments or examples.

Although explanatory embodiments have been shown and described, it would be appreciated by those skilled in the art that changes, alternatives, and modifications may be made in the embodiments without departing from spirit and principles of the disclosure. Such changes, alternatives, and modifications all fall into the scope of the claims and their equivalents.

What is claimed is:

1. A door closure structure for a rotary door rotatably mounted on a main body, wherein the door closure structure comprises:

a slide passage, formed in an upper end surface of the rotary door;

a hinge assembly, in which the rotary door is mounted on the main body by the hinge assembly and the hinge assembly comprises:

a hinge body, fixed on the main body, the hinge body including an inclined plate coupled to a front end of the hinge body;

a hinge plate, provided with a hinge hole, and connected to a rear end of the hinge body; and a hinge shaft fitted with the hinge hole; and a swing plate, in which a first end of the swing plate is pivotably connected to the hinge body, and an angle between the swing plate and the upper end surface of the rotary door ranges from 0 to 90°;

a spring having two ends connected to the swing plate and the hinge body respectively; and a roller rotatably disposed at a second end of the swing plate to catch into or roll out of the slide passage following a movement of the swing plate;

wherein the inclined plate is inclined upwardly from a first end thereof to a second end thereof, wherein the first end of the inclined plate is coupled to the front end of the hinge body and the swing plate is coupled to the second end of the inclined plate;

wherein in a closed state of the rotary door, the spring is configured to bias the roller against a surface of the slide passage to maintain closure of the rotary door;

wherein in moving the rotary door from the closed state to an open state, the spring's configured to stretch to allow the roller to move out of the slide passage.

2. The door closure structure according to claim 1, wherein the first end of the inclined plate is fixed with the front end of the hinge body and the swing plate is pivotably connected with the second end of the inclined plate.

3. The door closure structure according to claim 2, further comprising:

a first pin, wherein the swing plate is pivotably connected with the inclined plate via the first pin.

4. The door closure structure according to claim 2, wherein two parallel mounting bars spaced apart from each other are extended from the second end of the swing plate in the lateral direction, and the door closure structure further comprises a second pin fixed between the two mounting bars, in which the roller is fitted over the second pin.

5. The door closure structure according to claim 4, wherein the second pin is provided with two retainers disposed on two sides of the roller respectively.

6. The door closure structure according to claim 3, further comprising:

a supporting plate disposed below the swing plate and parallel with the upper end surface of the rotary door, wherein a first end of the supporting plate is fixed with the inclined plate.

7. The door closure structure according to claim 4, further comprising:

a supporting plate disposed below the swing plate and parallel with the upper end surface of the rotary door, wherein a first end of the supporting plate is fixed with the inclined plate.

8. The door closure structure according to claim 5, further comprising:

a supporting plate disposed below the swing plate and parallel with the upper end surface of the rotary door, wherein a first end of the supporting plate is fixed with the inclined plate.

9. A side-by-side refrigerator, comprising:

two door closure structures, wherein each door closure structure comprises:

a slide passage, formed in an upper end surface of the rotary door;

a hinge assembly, in which the rotary door is mounted on the main body by the hinge assembly and the hinge assembly comprises:

a hinge body, fixed on the main body, the hinge body including an inclined plate coupled to a front end of the hinge body;

a hinge plate, provided with a hinge hole, and connected to a rear end of the hinge body; and a hinge shaft fitted with the hinge hole; and a swing plate extended, in which a first end of the swing plate is pivotably connected to the hinge body, and an angle between the swing plate and the upper end surface of the rotary door ranges from 0 to 90°;

a spring having two ends connected to the swing plate and the hinge body respectively; and a roller rotatably disposed at a second end of the swing plate to catch into or roll out of the slide passage following a movement of the swing plate;

a main body with an open front surface, wherein the hinge bodies of the two door closure structures are respectively disposed on a left side and a right side of a front edge of the main body; and a left door and a right door rotatably mounted on the front surface of the main body, wherein the slide passages of the two door closure structures are disposed on upper end surfaces of the left door and the right door respectively;

wherein the inclined plate is inclined upwardly from a first end thereof to a second end thereof, wherein the first end of the inclined plate is coupled to the front end of the hinge body and the swing plate is coupled to the second end of the inclined plate;

wherein in a closed state of the rotary door, the spring is configured to bias the roller against a surface of the slide passage to maintain closure of the rotary door;

wherein in moving the rotary door from the closed state to an open state, the spring's configured to stretch to allow the roller to move out of the slide passage.

10. The side-by-side refrigerator according to claim 9, wherein notches are formed in inner walls of the upper end surfaces of the left door and the right door respectively, and a stopper having a surface with a predetermined slope is disposed in each notch, in which the slide passage is defined by the stopper and the notch.

11. The side-by-side refrigerator according to claim 10, wherein the stopper and the roller are made of polyformaldehyde.

12. The side-by-side refrigerator according to claim 9, wherein spacers are disposed on bottoms of the left door and the right door for adjusting height thereof respectively.

13. The side-by-side refrigerator according to claim 9, wherein:

the first end of the inclined plate is fixed with the front end of the hinge body and the swing plate is pivotably connected with the second end of the inclined plate.

14. The side-by-side refrigerator according to claim 13, wherein each door closure structure further comprises:

a first pin, in which the swing plate is pivotably connected with the inclined plate via the first pin.

15. The side-by-side refrigerator according to claim 13, wherein two parallel mounting bars spaced apart from each other are extended from the second end of the swing plate in the lateral direction, and the door closure structure further comprises a second pin fixed between the two mounting bars, in which the roller is fitted over the second pin.

16. The side-by-side refrigerator according to claim 15, wherein the second pin is provided with two retainers disposed on two sides of the roller respectively.

17. The side-by-side refrigerator according to claim 14, wherein each door closure structure further comprises:

a supporting plate disposed below the swing plate and parallel with the upper end surface of the rotary door, in which a first end of the supporting plate is fixed with the inclined plate.

18. The side-by-side refrigerator according to claim 15, wherein each door closure structure further comprises:

a supporting plate disposed below the swing plate and parallel with the upper end surface of the rotary door, in which a first end of the supporting plate is fixed with the inclined plate.

19. The side-by-side refrigerator according to claim 16, wherein each door closure structure further comprises:

a supporting plate disposed below the swing plate and parallel with the upper end surface of the rotary door, in which a first end of the supporting plate is fixed with the inclined plate.

* * * * *